US007446637B1

(12) United States Patent
Liang et al.

(10) Patent No.: US 7,446,637 B1
(45) Date of Patent: Nov. 4, 2008

(54) PARENT-CHILD LEADFRAME TYPE TRANSFORMER

(75) Inventors: Chi-Tsung Liang, Taoyuan Hsien (TW); Yu-Chun Chou, Taoyuan Hsien (TW); Chih-Hsien Liu, Taoyuan Hsien (TW)

(73) Assignee: FSP Technology Inc., Taoyuan Hsien (TW)

( * ) Notice: Subject to any disclaimer, the term of this patent is extended or adjusted under 35 U.S.C. 154(b) by 0 days.

(21) Appl. No.: 11/907,933

(22) Filed: Oct. 18, 2007

(51) Int. Cl.
*H01F 27/06* (2006.01)
*H01F 27/30* (2006.01)

(52) U.S. Cl. ..... 336/65; 336/208; 336/192

(58) Field of Classification Search ..... 336/212, 336/208, 198, 192
See application file for complete search history.

(56) References Cited

U.S. PATENT DOCUMENTS 5,010,314 A * 4/1991 Estrov ..... 336/198
6,867,678 B2 * 3/2005 Yang ..... 336/200
6,900,717 B2 * 5/2005 Timashov et al. ..... 336/208
6,958,673 B2 * 10/2005 Suzuki ..... 336/208
2007/0046414 A1 * 3/2007 Wu ..... 336/208
2007/0126542 A1 * 6/2007 He et al. ..... 336/83

FOREIGN PATENT DOCUMENTS

TW 422400 2/2001

* cited by examiner

*Primary Examiner*—Anh T Mai
(74) *Attorney, Agent, or Firm*—Muncy, Geissler, Olds & Lowe, PLLC

(57) ABSTRACT

A parent-child leadframe type transformer includes a ferrite core module, a child leadframe and a parent leadframe. The parent leadframe has a first opening and a second opening on both ends. The length of the second opening is greater than the length of the first opening along the same axial direction. A containing space is defined between the first and second openings. The child leadframe has a coil winding slot and a through hole for installing the ferrite core module. The axial length of the child leadframe falls between the first and second openings, such that the child leadframe and the ferrite core module can be passed through the second opening, but limited by the first opening. The child leadframe, ferrite core module and parent leadframe are positioned to define a parent-child type transformer structure for reducing the overall height and complying with the safety regulation standards.

9 Claims, 4 Drawing Sheets

PARENT-CHILD LEADFRAME TYPE TRANSFORMER

FIELD OF THE INVENTION

The present invention relates to a parent-child leadframe type transformer, and more particularly to an improved transformer structure for forming a thin transformer.

BACKGROUND OF THE INVENTION

Transformer is an indispensable component of different products having an electric power conversion function, but a traditional transformer must have sufficient space for accommodating a leadframe and a ferrite core as well as a reserved winding space, and thus the traditional transformer usually has a relatively large volume. However, the present development trend of various electronic products emphasizes on high efficiency and small size. Obviously, a traditional transformer has a relative large volume while all other components of the electronic product keep reducing their size. Furthermore, the transformer is installed above a circuit board of the electronic product, and too much space above the circuit board remains unused, and the remained space under the circuit board becomes crowded, and thus the effect of heat dissipation drops. As a result, the output power must be lowered to avoid overheat, and traditional transformers have difficulties in spatial layout for a thin product. However, there are thin transformers. In traditional thin transformers, metallic foil wires are laid on a plurality of printed circuit boards (PCB), and the plurality of PCBs are stacked, so that the plurality of metallic foil wires are stacked like a winding in the transformer and connected with a ferrite core module to form a transformer. Prior art of this sort has been disclosed in R.O.C Pat. Publication No. 422400 entitled "Improved transformer" in which the transformer comprises a set of ferrite cores, a set of circuit boards and an insulating coil, and a plurality of spiral loops are laid on the set of circuit boards and stacked to form a plurality of circuit boards, such that the plurality of spiral loops constitute a primary winding of the transformer, and the insulating coil clamped in the set of circuit boards serves as a secondary winding, and the ferrite core module and the set of circuit boards are positioned to form a transformer. The structure of the patented technology can reduce the overall height of the transformer, but the cost of stacking a plurality of PCBs is higher than the structure of a traditional transformer. Most of the transformers formed by stacking a plurality of PCBs are usually used for DC/DC conversion only due to the restriction of safety regulations. Area must be increased to meet the requirements of the safety regulations, but an increased area is not favorable for the spatial allocation of the circuits. Therefore, the two aforementioned structures of the prior art transformers have drawbacks, and require improvements.

SUMMARY OF THE INVENTION

In view of the deficiency of the foregoing prior art transformers, the primary objective of the present invention is to provide a structure that can effectively reduce the overall height of the transformer and also meet the requirements of safety regulations.

The present invention is a parent-child leadframe type transformer, comprising a ferrite core module, a child leadframe and a parent leadframe, wherein the parent leadframe has a first opening at an end of the parent leadframe, and a second opening disposed on another end of the parent leadframe, and the second opening is greater than the first opening, and a containing space is defined between the first opening and the second opening, and the child leadframe includes a through hole and a coil winding slot for installing the ferrite core module, and the axial length of the child leadframe falls between the first opening and the second opening, such that the child leadframe and the ferrite core module can be passed through the second opening, but limited within the internal side of the first opening, and the child leadframe, the ferrite core module and the parent leadframe are positioned to form a parent-child type transformer structure.

DETAILED DESCRIPTION OF THE PREFERRED EMBODIMENTS

Figure 1:
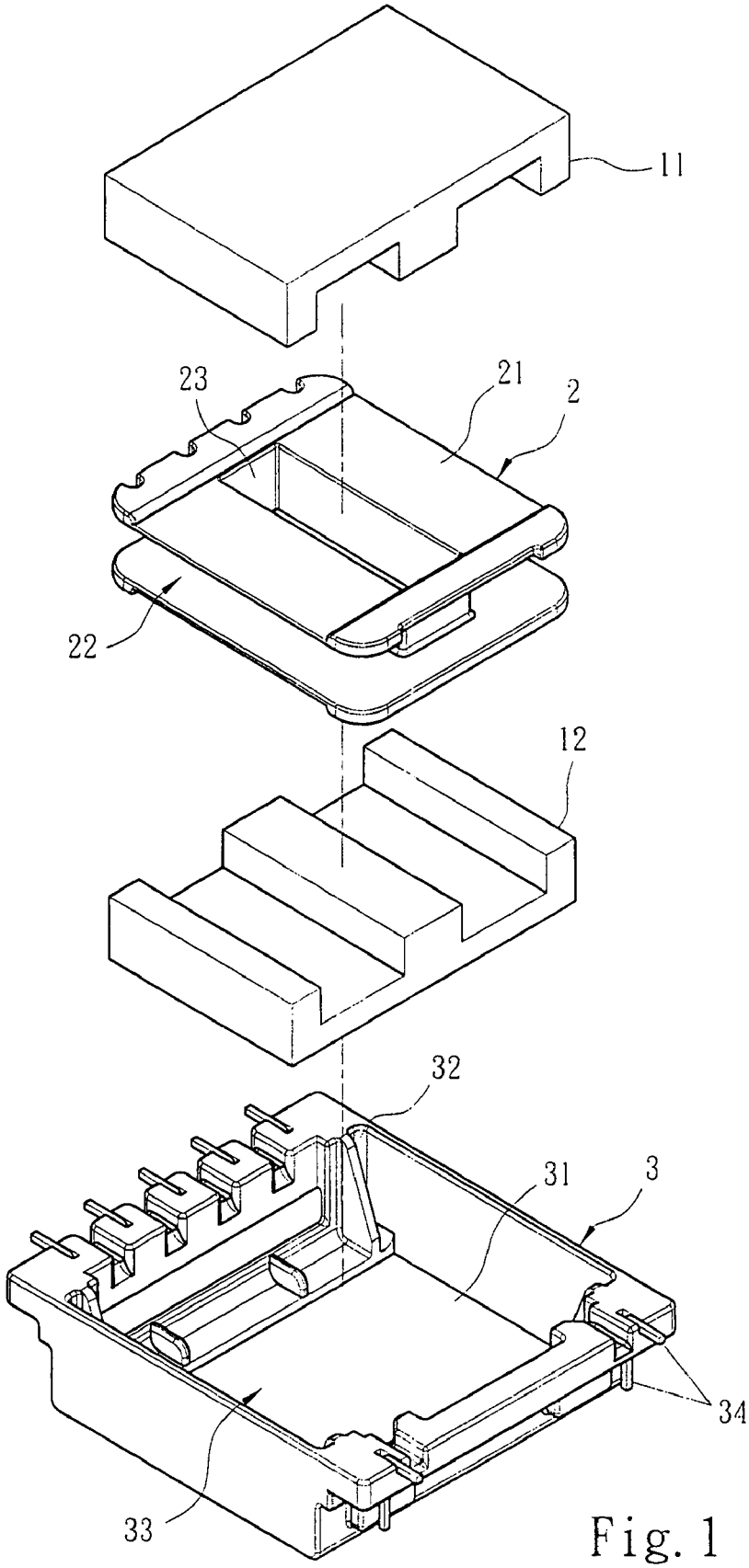
FIG. 1 is an exploded view of the present invention.
Figure 2:
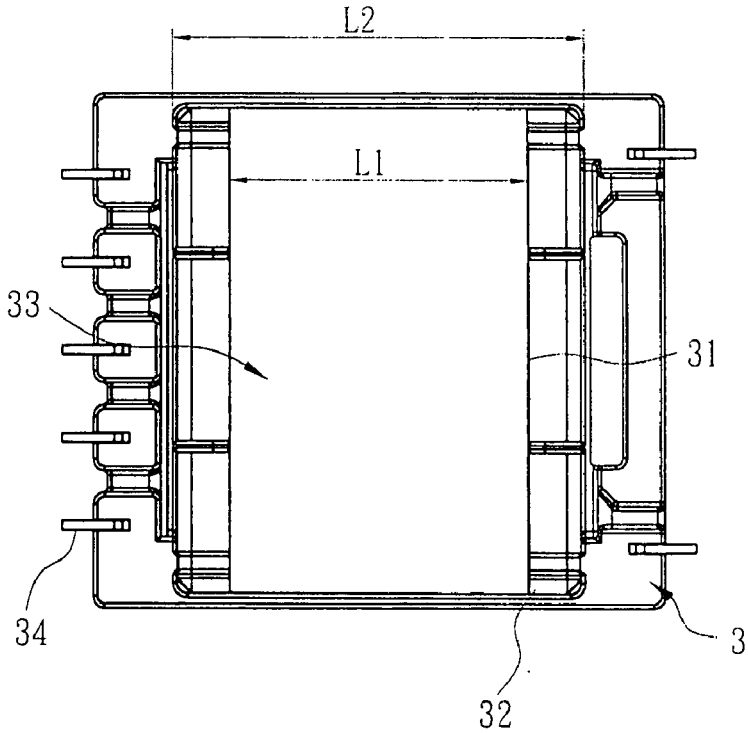
FIG. 2 is a top view of a parent leadframe of the present invention.
Figure 3:
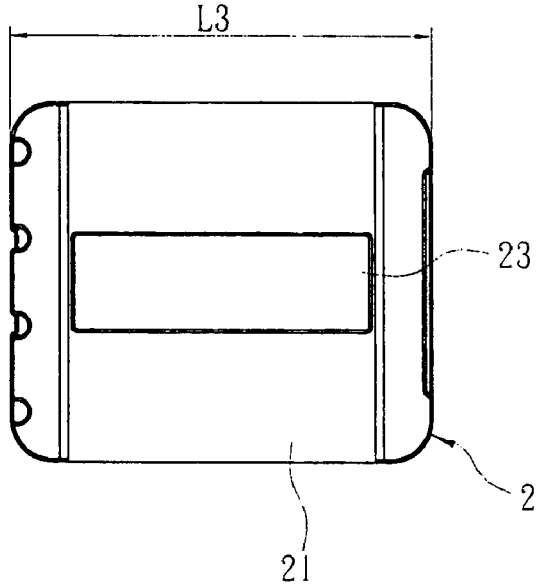
FIG. 3 is a top view of a child leadframe of the present invention.
Figure 5:
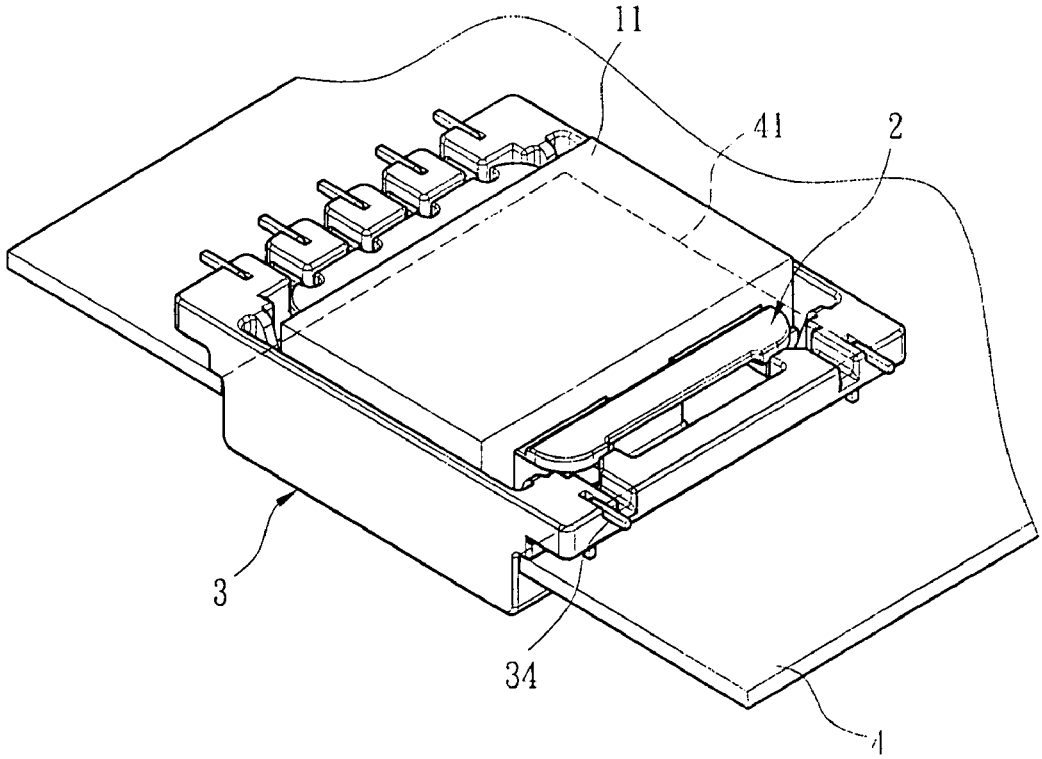
FIG. 5 is a perspective view of a preferred embodiment of the present invention.

The technical contents of the invention will now be described in more detail hereinafter with reference to the accompanying drawings that show various embodiments of the invention, Referring to FIGS. 1 to 3 for an exploded view of the invention, a top view of a parent leadframe of the invention, and a top view of a child leadframe of the invention respectively, the invention comprises the elements such as two ferrite cores 11, 12 for forming a ferrite core module of electromagnetic induction medium, a child leadframe 2 and a parent leadframe 3. The child leadframe 2 includes at least two partitions 21, at least one coil winding slot 22 formed at an interval between the plurality of partitions 21 for winding conductive wires into a primary winding and at least one secondary winding, and a through hole 23 at the interval having the coil winding slot 22 for positioning two ferrite cores 11, 12 to form a magnetic closed loop. The two ferrite cores 11, 12 can be a pair of E-shape ferrite cores 11, 12 embedded and fixed into the through hole 23 of the child leadframe 2, and the two E-shape ferrite cores 11, 12 are installed at an external side of the child leadframe 2 to form a loop. The parent leadframe 3 includes a first opening 31 at an end, a second opening 32 at another end, and a containing space 33 defined between the first opening 31 and the second opening 32, wherein the length L2 of the second opening 32 is greater than the length L1 of the first opening 31 in the same axial direction, and the length L3 along the axial direction of the child leadframe 2 falls within the length L1 of the first opening 31 and the length L2 of the second opening 32, such that the child leadframe 2 can be entered into the containing space 33 of the second opening 32, and restricted by the first opening 31 to limit its position within the containing space 33, and the size of the ferrite core 12 allows it to pass through the first opening 31 precisely, and thus further lowering the height of the ferrite cores 11, 12 and the child leadframe 2 protruded from the top of the parent leadframe 3. The parent leadframe 3 includes a plurality of lead terminals 34 extended towards the first opening 31, and the plurality of lead terminals 34 can be installed from a lateral edge of the parent leadframe 3 and the plurality of lead terminals 34 are extended towards both sides of the parent leadframe 3, such that the parent leadframe 3 on the parent leadframe 3 is in an L-shape, and the lead terminal 34 in two directions can be soldered to a circuit board 4 (as shown in FIG. 5) and a wound conducting wire respectively. Such design facilitates winding and soldering the transformer, shortens the production operating time, and provides a transformer structure capable of converting an input power into an output power.

Figure 4:
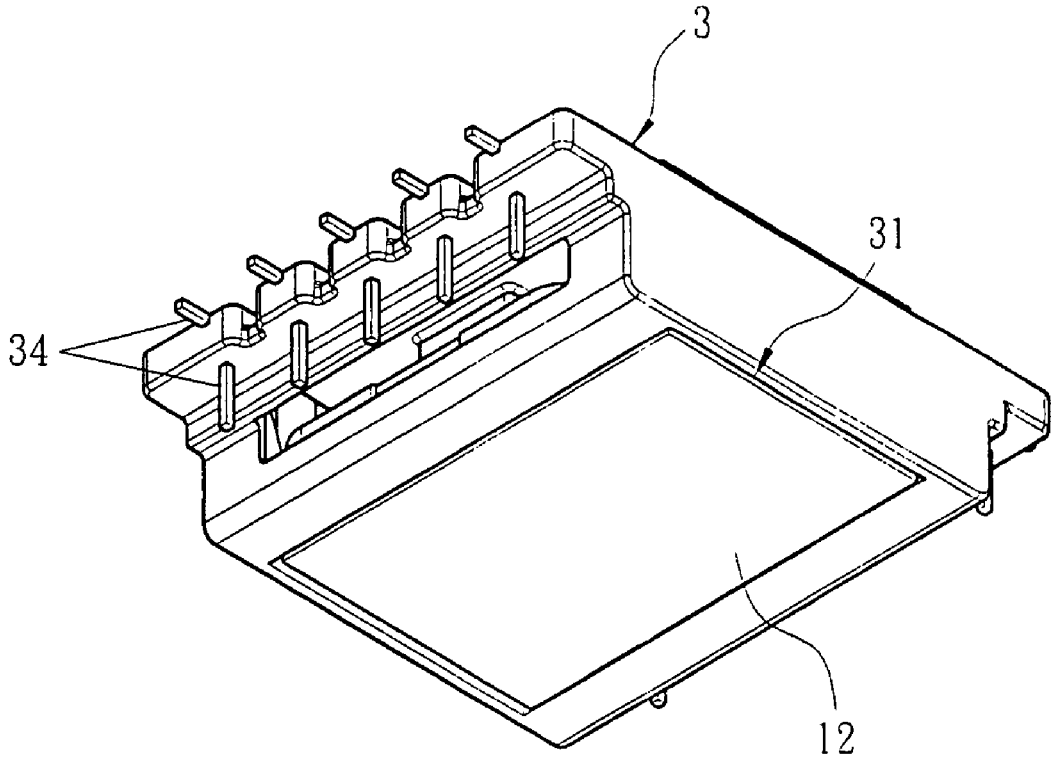
FIG. 4 is a perspective view of the present invention.
Figure 6:
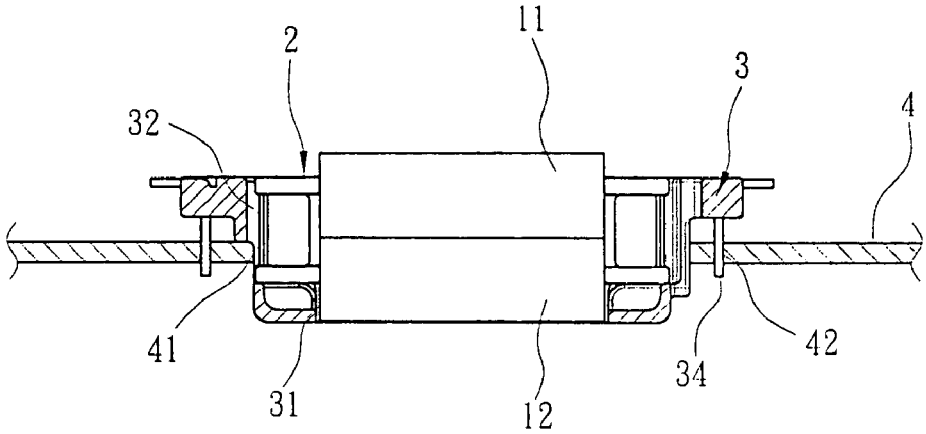
FIG. 6 is a sectional view of a preferred embodiment of the present invention.

Referring to FIGS. 4 to 6, the ferrite cores 11, 12 are positioned at the child leadframe 2, and then fixed into the containing space 33 of the parent leadframe 3 to form the parent-child leadframe type transformer in accordance with the present invention. In FIG. 4, the parent leadframe 3 includes a plurality of lead terminals 34, and a portion of lead terminals 34 is extended from the second opening 32 towards the first opening 31, and another portion of lead terminals 34 is extended from a lateral edge of the parent leadframe 3 towards both sides, and the plurality of lead terminals 34 are disposed in an L-shape. In FIG. 5, the parent-child leadframe type transformer is fixed onto a circuit board 4, and the circuit board 4 has a penetrating hole 41 for precisely embedding and installing the parent-child leadframe type transformer, such that the parent-child leadframe type transformer can be embedded into the penetrating hole 41, and the plurality of lead terminals 34 can be extended from the second opening 32 towards the first opening 31, and the lead terminal 34 can be passed from top to bottom through the plurality of positioning holes 42 of the circuit board 4 and soldered onto the circuit board. Therefore, the parent-child leadframe type transformer can be protruded from the bottom of the circuit board 4, and the space below the circuit board 4 can reduce the height of the parent-child leadframe type transformer protruded from the top of the circuit board 4. Since the lead terminal 34 still has sufficient length after passing through the circuit board 4, the section of soldering the lead terminal 34 to the circuit board 4 is used for adjusting the relative positions of the parent-child leadframe type transformer and the circuit board 4. Since the winding in the coil winding slot 22 of the child leadframe 2 and an insulating parent leadframe 3 in the interval of the circuit board 4 give sufficient insulation between the winding in the child leadframe 2 and the circuit board 4, the shortcoming of the prior art PCB stacked transformer unable to pass the safety regulation standards can be overcome. In addition, the structure of the parent-child leadframe type transformer can be used for either DC/DC or AC/DC adapter at the same time.

Although the invention is disclosed by using the above-mentioned embodiments, the invention is not limited to such arrangements only, but the lead terminal 34 can be extended from the first opening 31 towards the second opening 32, and the ferrite core module can be an E-shape ferrite core 11 and an I-shape ferrite core 12, and the E-shape ferrite core 11 can be embedded into the through hole 23 of the child leadframe 2, and the I-shape ferrite core 12 can be connected to another side of the child leadframe 2 and the E-shape ferrite core 11 to form a loop, and the ferrite core module can be a combination of ferrite cores 11, 12 in other forms.

While the invention has been described by means of specific embodiments, numerous modifications and variations could be made thereto by those skilled in the art without departing from the scope and spirit of the invention set forth in the claims.

In summation of the description above, the present invention improves the aforementioned effects of the prior art, and complies with the requirements of patent application, and thus is duly filed for patent application.

What is claimed is:

1. A parent-child lead frame type transformer, having a transformer structure for receiving and converting an input power into an output power, and the parent-child leadframe type transformer, characterized by:

a parent leadframe, having a first opening disposed at an end of the parent leadframe, and a second opening disposed at another end of the parent leadframe, wherein the length of the second opening is greater than the length of the first opening along the same axial direction, and a containing space is defined between the first opening and the second opening, the parent leadframe including a plurality of lead terminals disposed on a lateral edge of the parent leadframe;

a child leadframe, having at least one coil winding slot for coiling a primary winding and at least one secondary winding therein, a through hole separated with the coil winding slot, a ferrite core module installed in the through hole, a magnetic closed loop formed around the external periphery of the child leadframe, an axial length of the child leadframe falling within the length of the first opening and the length of the second opening, such that the child leadframe and the ferrite core module are passed through the second opening and limited by the first opening to position the child leadframe and the ferrite core module in the containing space of the parent leadframe to constitute a transformer structure.

2. The parent-child leadframe type transformer of claim 1, wherein the ferrite core module is comprised of an E-shape ferrite core and an I-shape ferrite core, and the E-shape ferrite core is embedded into a through hole of the child leadframe, and the I-shape ferrite core is connected to another side of the child leadframe and the E-shape ferrite core to define a loop.

3. The parent-child leadframe type transformer of claim 1 wherein the lead terminal is extended from the second opening towards the first opening.

4. The parent-child leadframe type transformer of claim 1 wherein the lead terminal is extended from the first opening towards the second opening.

5. The parent-child leadframe type transformer of claim 1 wherein the lead terminal is extended from a lateral edge of the parent leadframe towards both sides of the parent leadframe.

6. The parent-child leadframe type transformer of claim 1, wherein the plurality of lead terminals are extended from a lateral edge of the parent leadframe towards both sides of the parent leadframe and extended from the second opening towards the first opening respectively.

7. The parent-child leadframe type transformer of claim 1, wherein the child leadframe installs at least two partitions, such that the coil winding slot is formed between the partitions.

8. The parent-child leadframe type transformer of claim 1, wherein the first opening has a size capable of passing through the ferrite core precisely.

9. The parent-child leadframe type transformer of claim 1, wherein the ferrite core module is a pair of E-shape ferrite cores embedded correspondingly into a through hole of the child leadframe.

* * * * *